United States Patent [19]

Yotsuya et al.

[11] Patent Number: 4,727,377

[45] Date of Patent: Feb. 23, 1988

[54] WINDOW ANTENNA FOR A VEHICLE WITH DUAL FEED POINTS

[75] Inventors: Hiroshi Yotsuya; Yoshiro Okamoto, both of Toyota; Hiroshi Kondo, Toyota; Kaoru Sakurai, Kawasaki; Harunori Murakami, Machida; Hajime Murakami, Yokohama, all of Japan

[73] Assignees: Toyota Jidosha Kabushiki Kaisha, Aichi; Nippon Sheet Glass Co., Ltd., Osaka, both of Japan

[21] Appl. No.: 863,708

[22] Filed: May 15, 1986

[30] Foreign Application Priority Data

May 20, 1985 [JP] Japan ..... 60-107983

[51] Int. Cl.[4] ..... H01Q 1/32

[52] U.S. Cl. ..... 343/713; 343/711; 343/712

[58] Field of Search ..... 343/704, 713, 711, 712

[56] References Cited

U.S. PATENT DOCUMENTS 3,964,068 6/1976 Torii et al. ..... 343/713

4,608,570 8/1986 Inaba et al. ..... 343/713

FOREIGN PATENT DOCUMENTS 2106647 2/1971 Fed. Rep. of Germany ..... 343/713

0198007 11/1984 Japan ..... 343/713

*Primary Examiner*—William L. Sikes

*Assistant Examiner*—Doris T. Johnson

*Attorney, Agent, or Firm*—Dennis J. Williamson

[57] ABSTRACT

A pair of antenna elements are mounted on a glass of a rear quarter window of a vehicle. Feed points of these elements are provided at a corner portion of the window. One antenna element extends clockwise about the center of the window glass and the other antenna element extends counterclockwise thereabout from their corresponding feed points. The characteristics of both antenna elements significantly differ and complement each other. It is convenient for a diversity reception system. An auxiliary element branches from one antenna element to extend along the other antenna element. The auxiliary element compensates for impedance characteristics of the antenna elements to tune up reception characteristics thereof.

15 Claims, 26 Drawing Figures

MEAN 37.1 dBμ
MIN 31.6 dBμ(0°)
MAX 39.0 dBμ
DIR. 5.5 dBμ

MEAN 39.0 dBμ
MIN 32.5 dBμ(52°)
MAX 42.9 dBμ
DIR. 6.5 dBμ

MEAN 38.4 dBμ
MIN 33.3 dBμ(22°)
MAX 43.7 dBμ
DIR. 6.1 dBμ

MEAN 44.5 dBμ
MIN 39.8 dBμ(13°)
MAX 48.0 dBμ
DIR. 4.7 dBμ

MEAN 43.1dBμ
MIN 36.8dBμ(179°)
MAX 49.3dBμ
DIR. 6.3dBμ

MEAN 42.4 dBμ
MIN 34.7 dBμ(184°)
MAX 47.4 dBμ
DIR. 7.7 dBμ

MEAN 33.6 dBμ
MIN 25.1 dBμ(2°)
MAX 38.5 dBμ
DIR. 8.5 dBμ

MEAN 33.2 dBμ
MIN 26.6 dBμ(330°)
MAX 37.2 dBμ
DIR. 6.6 dBμ

MEAN 20.5 dBμ
MIN 5.3 dBμ(128°)
MAX 25.1 dBμ
DIR. 15.2 dBμ

WINDOW ANTENNA FOR A VEHICLE WITH DUAL FEED POINTS

BACKGROUND OF THE INVENTION

1. Field of the Invention

The present invention relates to a window antenna for a vehicle and, more particularly, to a window antenna which can reliably receive a TV broadcast wave.

2. Description of the Prior Art

As is conventionally known, a radio-reception antenna wire can be provided on a surface on the passenger compartment side of the rear windshield of a vehicle, in addition to a plurality of defogging heater wires. Such an antenna wire is normally tuned to sensitively receive a radio broadcast signal in the AM and FM bands, but cannot receive a TV broadcast signal. Therefore, in order to receive both radio and TV broadcast signals in the vehicle compartment, a special-purpose antenna for receiving a TV broadcast signal must be additionally provided.

It is generally difficult to mount a broad-band Yagi antenna for receiving a TV broadcast signal on a vehicle. Therefore, a TV antenna wire must be arranged on a surface of the vehicle, as in the case of an AM/FM window antenna. However, since the vehicle body is formed mainly of an iron plate and the rear windshield is occupied by the radio antenna wire, possible mounting areas for the TV antenna are limited. It is undesirable to mount the antenna wire on the front windshield, with regard to the field of view.

Even if the TV antenna can be mounted, a TV broadcasting frequency extends over a wide range, for example in Japan, from a low frequency range (90 to 108 MHz of channel Nos. 1 to 3) to a high frequency range (170 to 222 MHz of channel Nos. 4 to 12). Therefore, it is very difficult to cover such a broad bandwidth as well as a UHF band with a single antenna.

SUMMARY OF THE INVENTION

The present invention has been made in consideration of the above situation, and has as its object to provide a window antenna which effectively utilizes a limited antenna mounting area, and which can reliably receive a TV broadcast signal.

According to the present invention, a pair of antenna elements are provided on one or two rear side windows, feed points of the respective elements are arranged near one corner portion of the window, one antenna element extends clockwise about the center of the glass from its corresponding feed point, and the other antenna element extends counterclockwise thereabout from its corresponding feed point. An auxiliary element branches from one or both the antenna elements and extends along the other antenna element.

Since extending directions of the respective antenna elements are opposite to each other, a difference between antenna characteristics of these elements is significantly enhanced, and they can therefore be suitably applied to a diversity reception system. The auxiliary element extended between both the antenna elements compensates for impedance characteristics of both the elements, and tuned-up reception characteristics can be obtained.

These and other objects and many of the attendant advantages of this invention will be readily appreciated as the same becomes better understood by reference to the following detailed description when considered in connection with the accompanying drawings.

BRIEF DESCRIPTION OF THE DRAWINGS

FIGS. 1 to 5 and FIGS. 10, 12, and 17A to 17I show a first embodiment of the present invention, in which FIG. 1 is an illustration of a basic pattern of an antenna wire arranged on a rear side window of a vehicle, FIG. 2 is an illustration of an actually tuned pattern corresponding to FIG. 1, FIG. 3 is a graph showing the frequency-gain characteristics of the VHF band of the pattern shown in FIG. 2, FIG. 4 is a graph showing the frequency-gain characteristics of the UHF band, FIGS. 5, 10, 12, 13, and 14 are illustrations of modifications of window antenna patterns according to the first embodiment of the present invention, and FIGS. 17A to 17I are directivity diagrams of the window antenna according to the first embodiment of the present invention; and FIGS. 6 to 9 and FIGS. 11, 15, and 16 show a second embodiment of the present invention, in which FIG. 6 is an illustration of an antenna pattern in which an auxiliary element is added to the pattern shown in FIG. 2, FIG. 7 is a Smith chart of an antenna element shown in FIG. 6, FIG. 8 is a graph showing the frequency-gain characteristics of the VHF band, FIG. 9 is a graph showing the frequency-gain characteristics of the UHF band, and FIGS. 11, 15, and 16 are illustrations of modifications of the window antenna pattern according to the second embodiment of the present invention.

DETAILED DESCRIPTION OF THE PREFERRED EMBODIMENTS

FIGS. 1, 2, 5, 6, and 10 to 16 show embodiments of the present invention, in which a TV antenna wire 2 is provided on a window glass (rear quarter window) 1, which is mounted in a rear quarter window frame portion of a vehicle, by printing and baking a conductive paste material thereon. The rear quarter window 1 may be of a fitted type, or a pivoted vent or a slidable vent. The antenna wire 2 is provided on one or both rear side window glasses 1. When two antenna wires 2 are symmetrically provided on two side window glasses 1, they are combined in a diversity reception system which selects the reception signal having the higher reception level between the signals from the two antenna wires 2.

Figure 18:
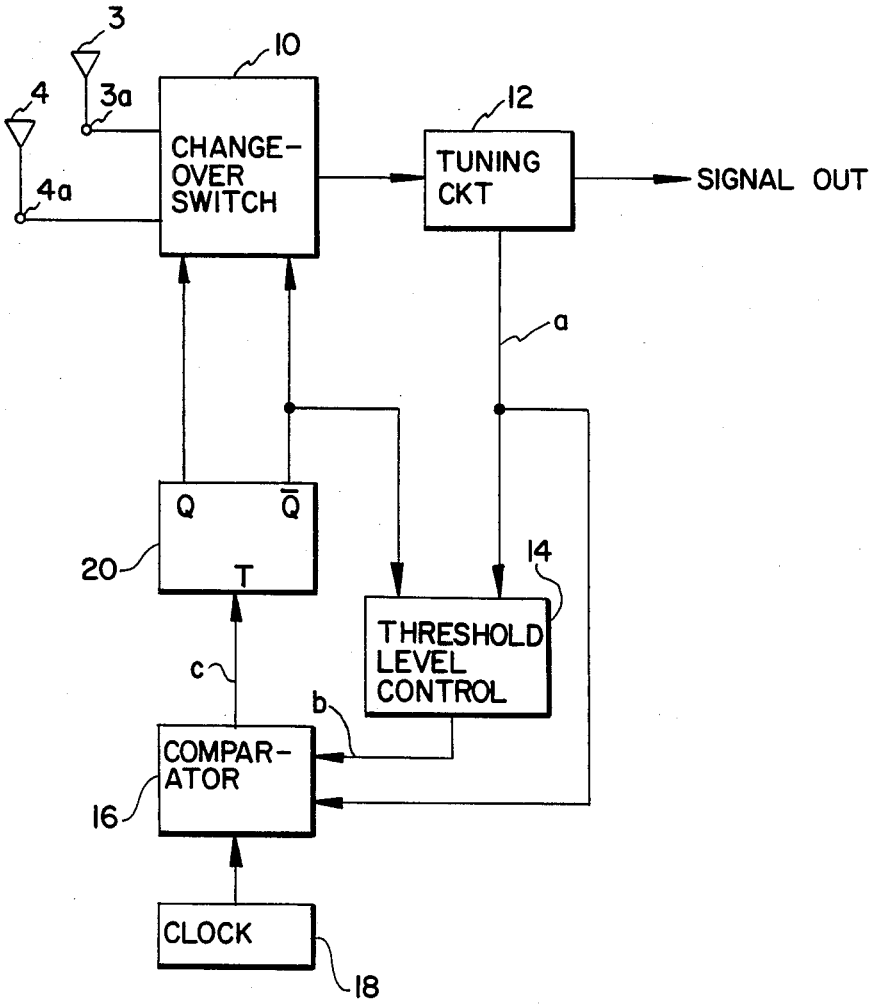
FIG. 18 PRIOR ART
FIG. 18 shows the details of the diversity reception system.

In the operation of the well-known diversity reception system, shown in FIG. 18, the reception signals obtained at feed points *3a*, *4a* are fed to a changeover switch through preamplifiers (not shown). A selected reception signal, e.g. at *3a*, is then supplied to a tuning circuit 12 which includes a front-end unit, an IF circuit, a detector circuit etc. The tuning circuit 12 outputs a detection signal to a next stage such as a video amplifier and a color decoder.

The tuning circuit 12 includes a level detector for detecting a level or an amplitude of the reception signal and outputs a level detection signal a to a threshold level controller 14. The threshold level controller sets and holds a threshold level b for discriminating a decrease or increase of the level detection signal a. The level detection signal a and threshold level b are fed to a comparator 16 to be compared therein.

When the level detection signal a decreases below the threshold level b, a change-over signal c is generated in synchronism with a clock pulse e.g. 100 KHz supplied by a clock pulse circuit 18. The change-over signal c is fed to a trigger terminal of a steering flip-flop 20 to switch over. The switched Q and Q outputs of the flip-flop 20 are supplied to change-over switch 10 to change over the reception signal at the feed point 3*a* to a signal at the feed point 4*a*. Then, the reception signal from the antenna 4 having a higher level than the former is processed by the tuning circuit 12 and the signal level thereof is now discriminated at the comparator 16.

The $\overline{Q}$ output of the flip-flop 20 is supplied to a threshold level controller 14 to modify automatically the threshold level b in accordance with a change-over frequency. The threshold b is finely modified either downwardly or upwardly so as to increase the change-over frequency. Thus, the threshold level is finely adjusted just on the generally crossing level of two reception signals from the feed points 3*a* and 4*a*. At the crossing level of two reception signals, the change-over occurs most frequently.

The antenna wire 2 basically consists of a pair of antenna elements 3 and 4, which are arranged along an edge of the window glass 1 and respectively have feed points 3*a* and 4*a*. In order to allow easy handling of feeders, the feed points 3*a* and 4*a* are concentrated near a corner portion 1*b* of the window glass 1. The antenna element 3 extends clockwise about the center of the glass along an edge 1*e* from the feed point 3*a*, and the other antenna element 4 extends counterclockwise thereabout from the feed point 4*a* along an edge 1*a*.

With this arrangement, mutual interference between the antenna elements 3 and 4 can be suppressed, and a frequency and directivity characteristics thereof differ significantly from each other, thus obtaining a reception output suited for the diversity reception system.

Figure 1:
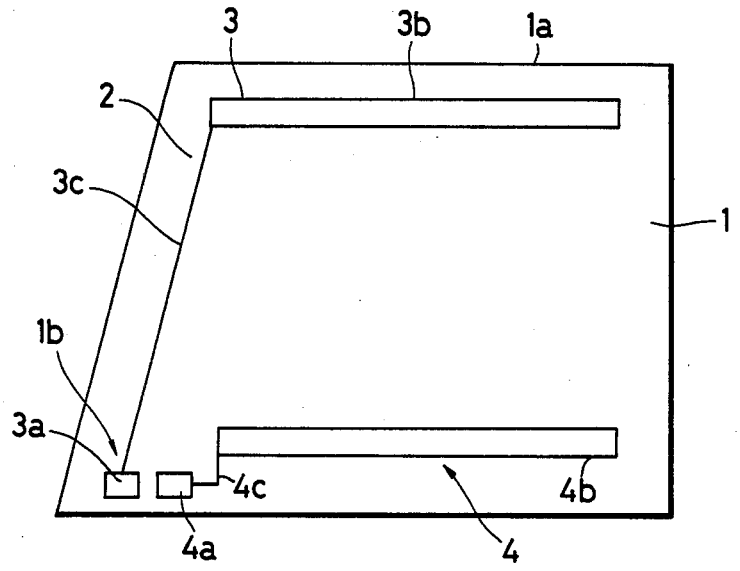
Figure 2:
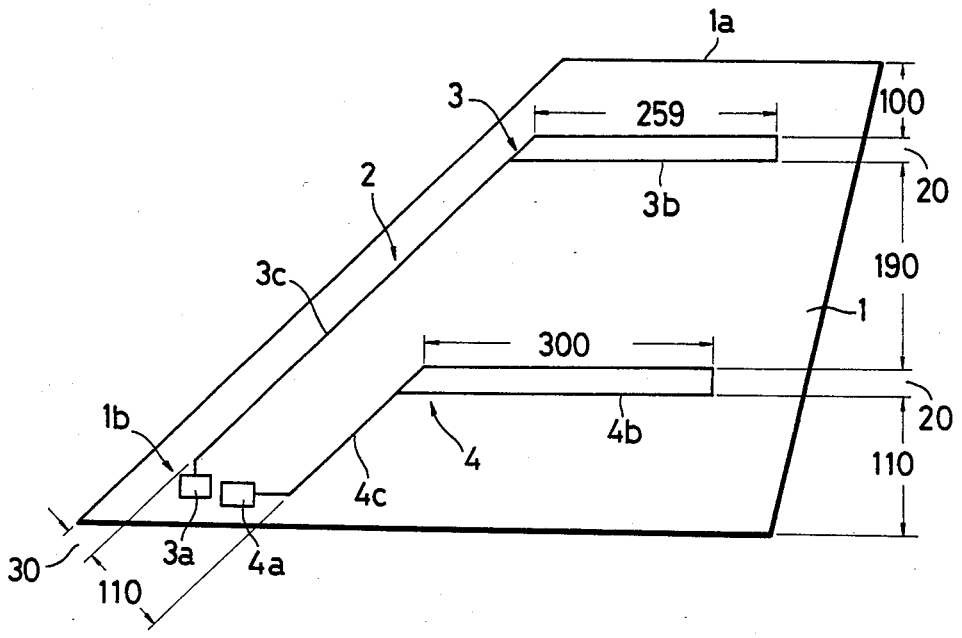
Figure 5:
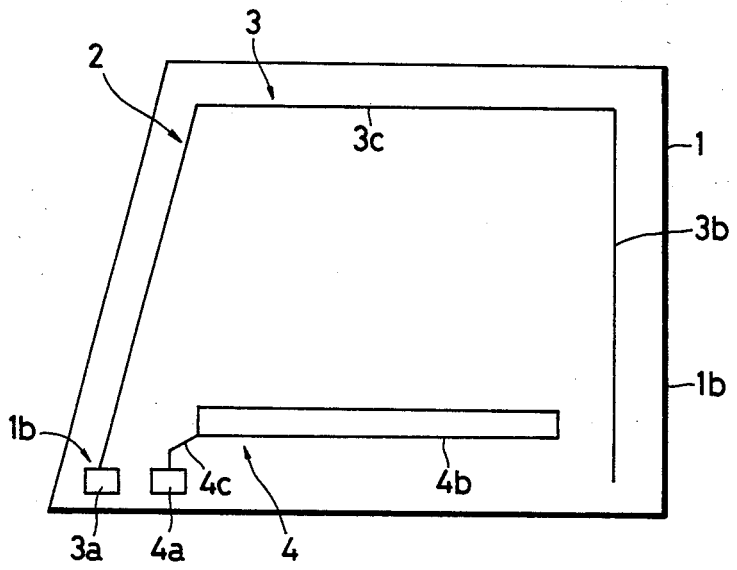
Figure 6:
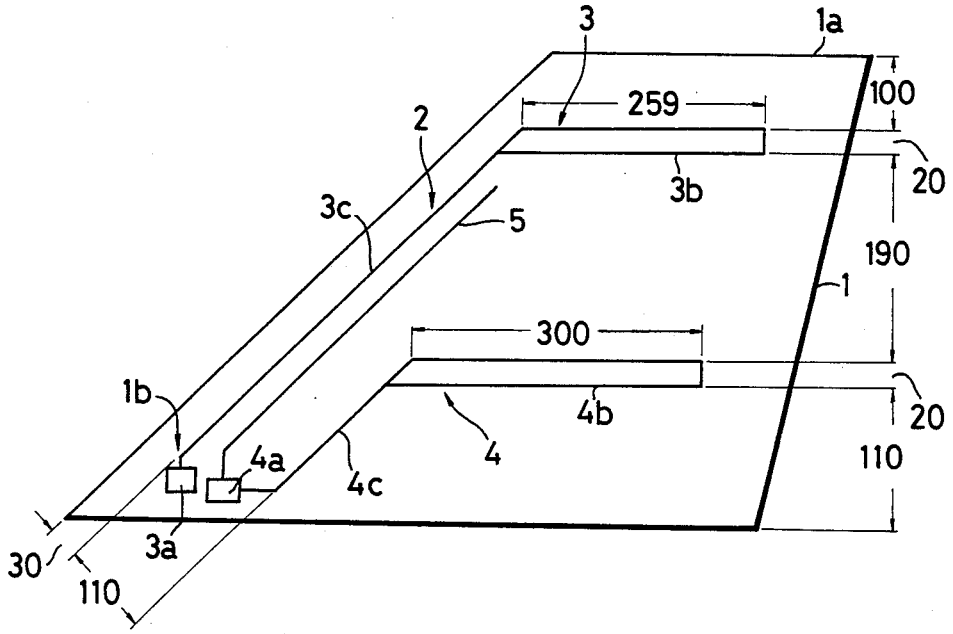

Referring to FIGS. 1, 2, and 6, a main element 3*b* of the antenna element 3 consists of two parallel wires which extend along an upper side of the window glass 1 and are respectively short-circuited at both ends thereof. The main element 3*b* is coupled to the feed point 3*a* through a feeder element 3*c* to extend clockwise. Referring to FIGS. 1, 2, 5, and 6, a main element 4*b* of the antenna element 4 also consists of two parallel wires which extend along a lower side of the window glass 1 and are respectively short-circuited at both ends thereof. The main element 4*b* is coupled to the feed point 4*a* through a feeder element 4*c*. The feeder elements 3*c* and 4*c* have a low gain when acting as antennas, and positions of the feed points 3*a* and 4*a* can therefore be determined without limiting performance of the main elements 3*b* and 4*b*. The feed points 3*a* and 4*a* are preferably arranged to keep mutual interference as low as possible.

As shown in FIG. 11 and FIGS. 13 to 16, distal end portions 3*d* and 4*d* of the antenna elements 3 and 4 can be extended to be adjacent to each other. With these modifications, an effective antenna length can be increased, and the antenna elements 3*c* and 4*c* act as reflectors or waveguide means for the opposing antenna elements 3 and 4. This improves the directivity of the respective antenna elements.

Figure 3:
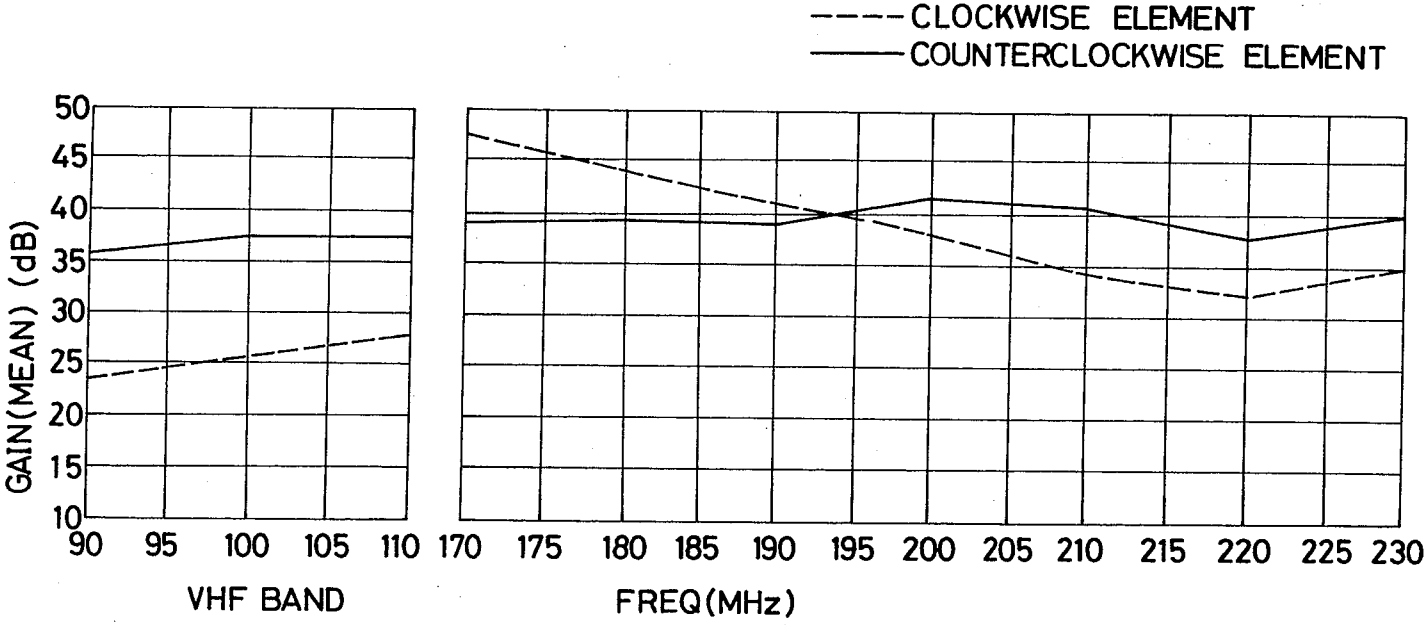
Figure 4:
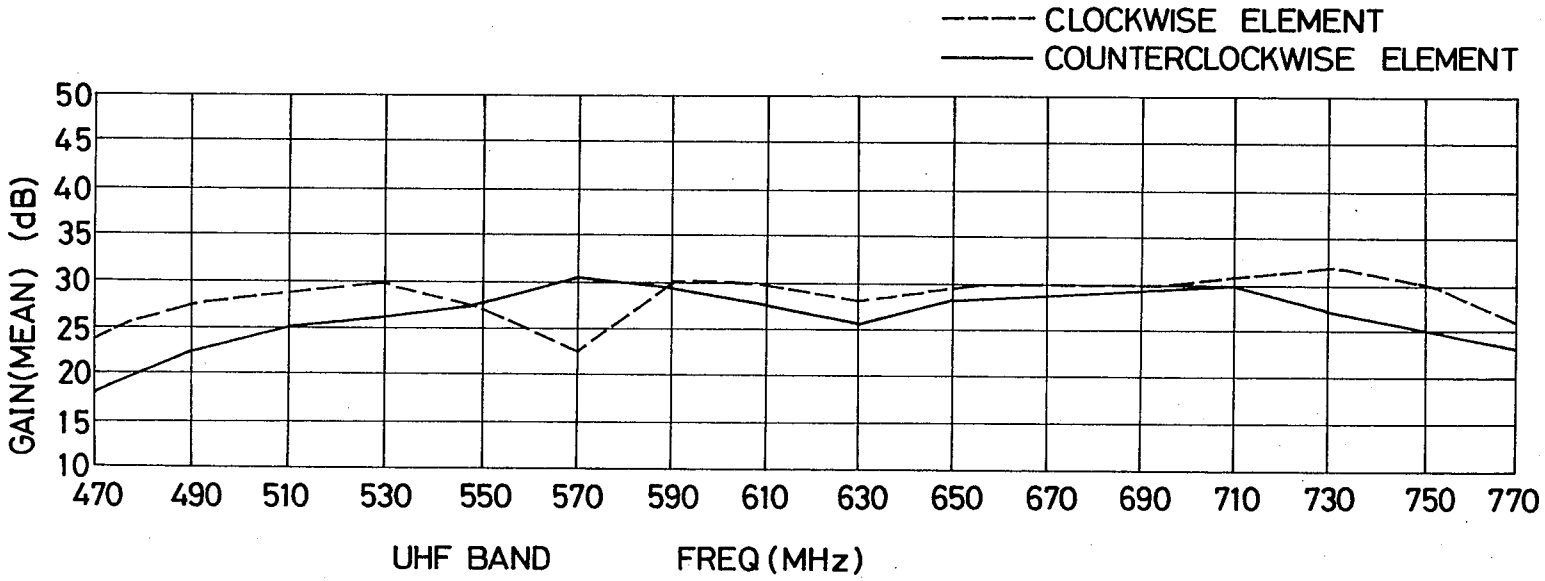

FIG. 2 shows an embodiment of the basic arrangement shown in FIG. 1, in which the antenna elements are tuned to obtain good sensitivity in the TV broadcasting band. FIG. 3 is a frequency-gain graph of the antenna pattern shown in FIG. 2 in the VHF band (90 to 230 MHz; a horizontally polarized wave), in which a dotted line corresponds to the element 3 and a solid line, to the element 4. FIG. 4 is substantially the same graph as in FIG. 3 except for in the UHF band (470 to 770 MHz). As shown in FIGS. 3 and 4, the gains of the two antenna elements 3 and 4 complement each other, and stable reception is allowed when diversity reception is performed.

FIG. 5 shows a modification of the basic pattern shown in FIG. 1, in which the distal end of the antenna element 3 extends further clockwise. In this case, a wire, extending downward along the side edge of the window glass 1 to a position near the lower side thereof, is the main element 3*b*, which is coupled to the feed point 3*a* through the feeder element 3*c*.

FIGS. 6, 11, 15, and 16 show a second embodiment of the present invention. In this embodiment, an auxiliary element 5 branches from one antenna element (in this case, the element 4), and extends along the other antenna element 3, thereby changing the impedances of the elements 3 and 4 at the feed points 3*a* and 4*a*, so as to improve reception sensitivity. FIG. 6 shows a tuned antenna pattern corresponding to that in FIG. 2. In FIG. 6, the auxiliary element 5 extends from the feed point 4*a* of the element 4, but can branch from another portion of the element 4. Alternatively, an auxiliary element can branch from the element 3 to extend along the element 4.

Figure 7:
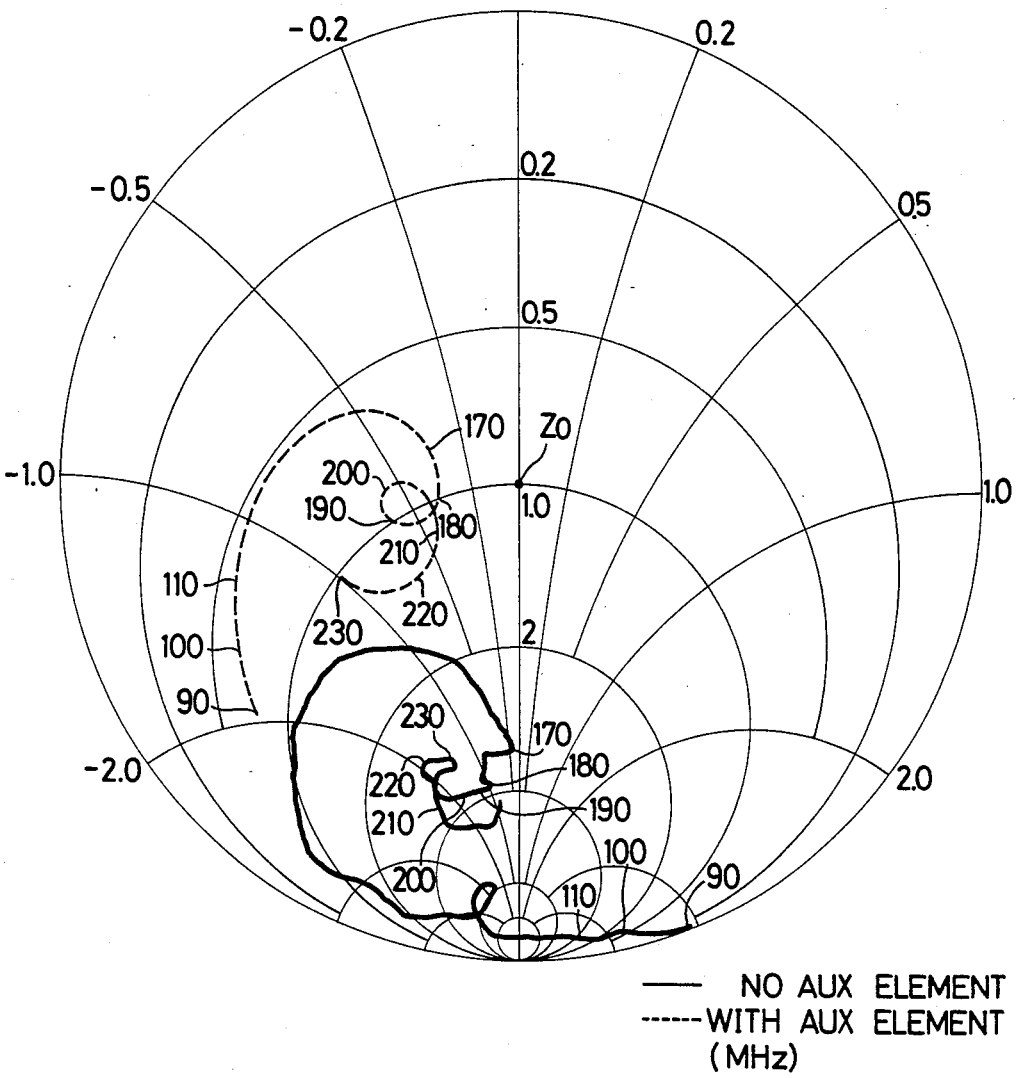

FIG. 7 is a Smith chart of the window antenna shown in FIG. 6, showing the frequency-impedance characteristics of the antenna element 3. As indicated by a solid line in FIG. 7, when the auxiliary element 5 is omitted, the impedance of the element 3 considerably exceeds a target value. 50 Ω (point $Z_0$) As indicated by a dotted line in FIG. 7, when the auxiliary element 5 is added, the impedance can be improved significantly.

Figure 8:
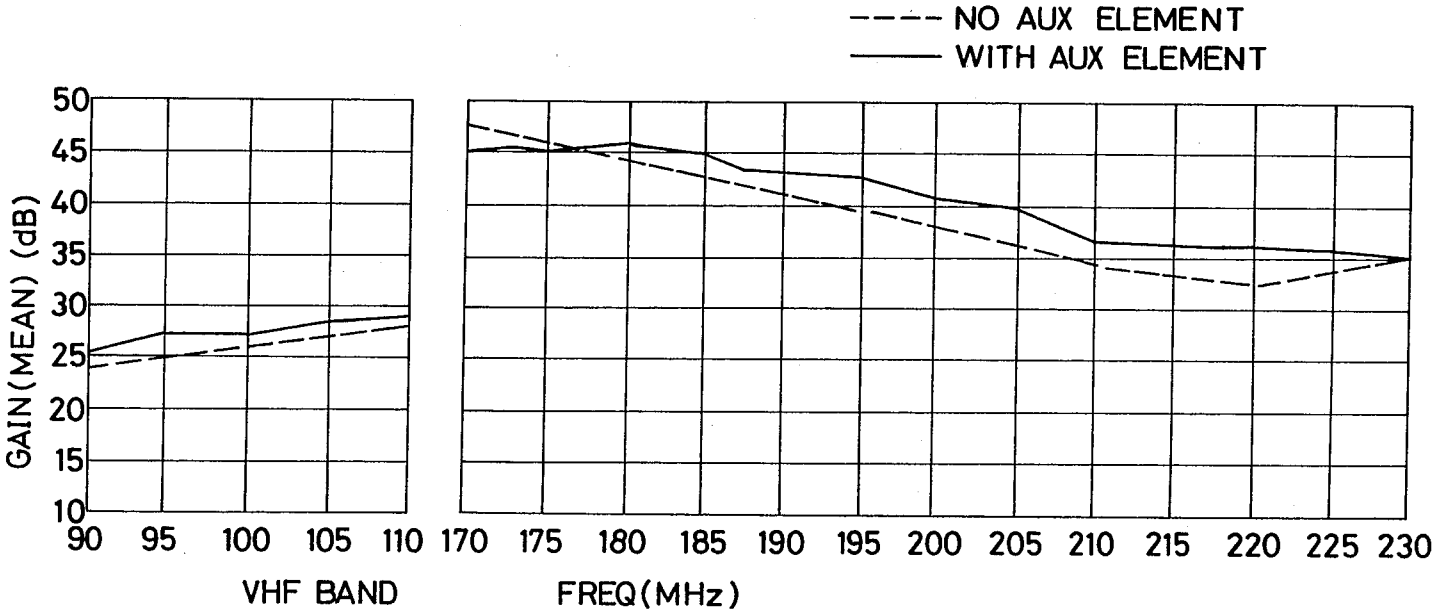
Figure 9:
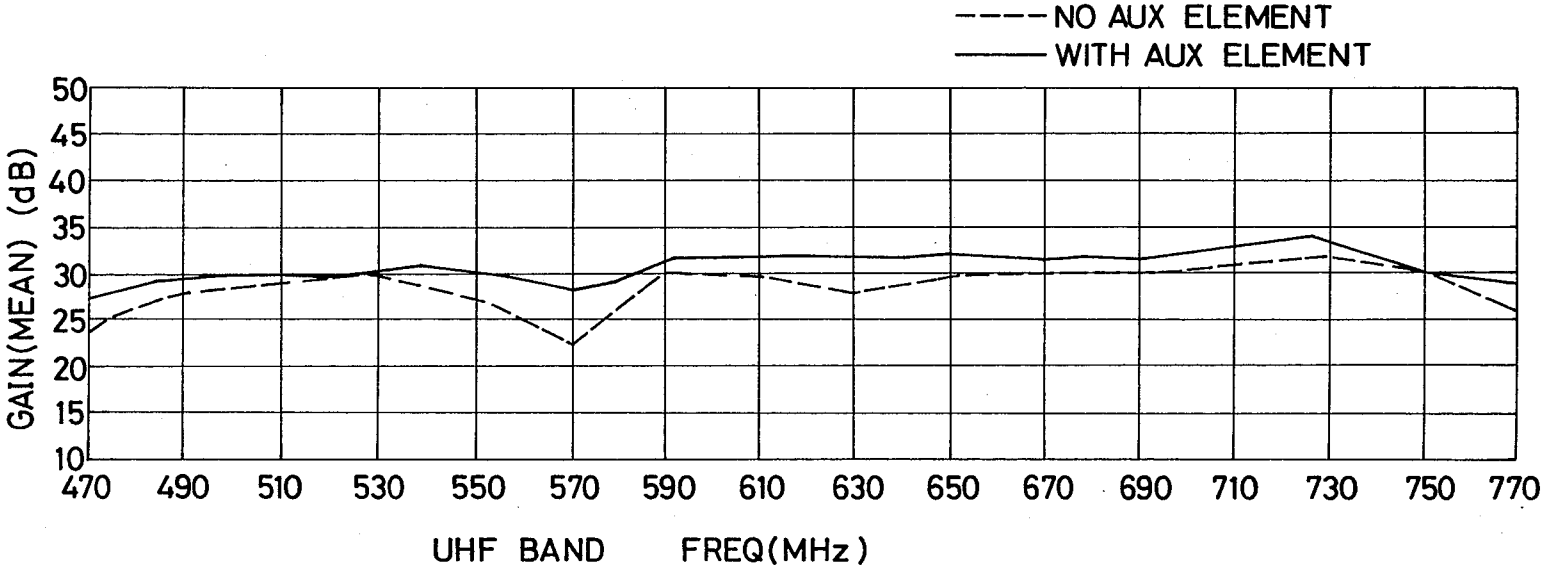
Figure 10:
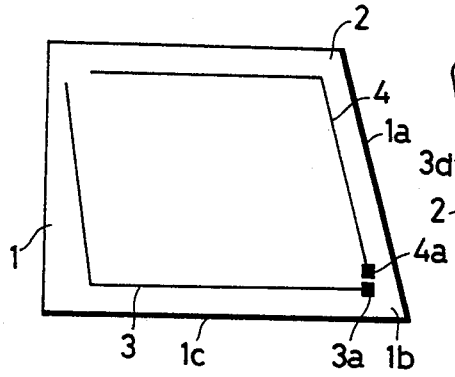
Figure 11:
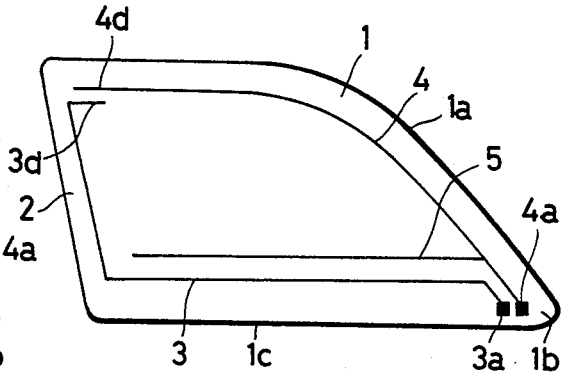
Figure 12:
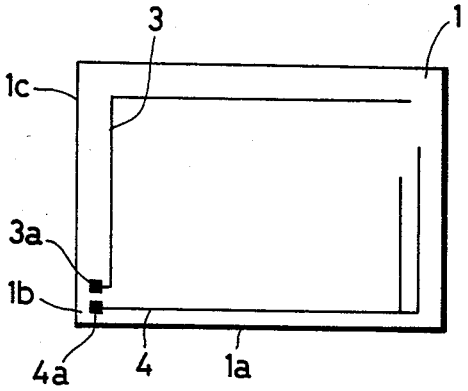
Figure 13:
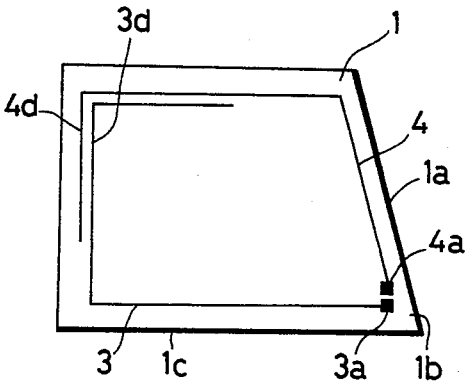

FIG. 8 is the frequency-gain graph of the antenna element 3 of FIG. 6 in the VHF band (a horizontally polarized wave), in which a dotted line indicates the result without the auxiliary element 5, and the solid line indicates the result with it. FIG. 9 is a similar graph in the UHF band. As shown in FIGS. 8 and 9, the reception gain can be increased due to improvement in the impedance.

When the antenna element 4 is connected to the auxiliary element 5, the impedance thereof at the feed point 4*a* is changed. Therefore, the impedances of the elements 3 and 4 can be tuned to obtain the optimal value 50 Ω upon use of the auxiliary element 5.

Figure 14:
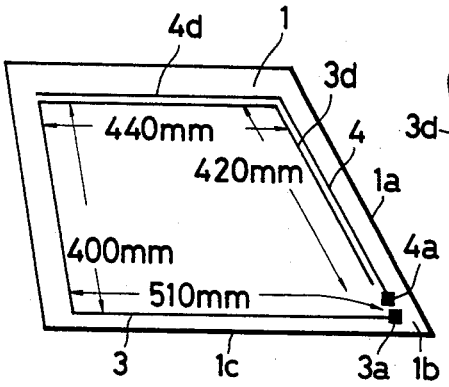
Figure 15:
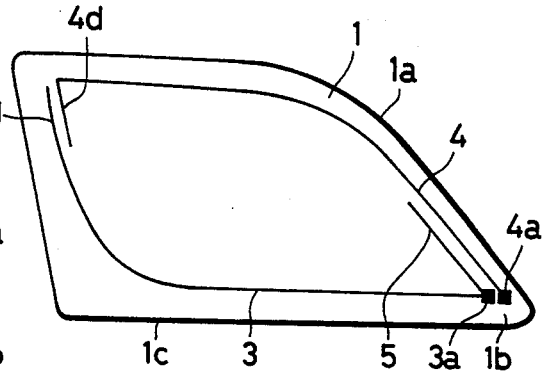
Figure 16:
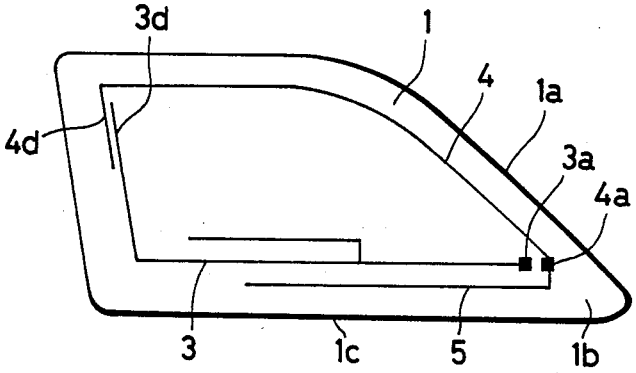
Figure 17A:
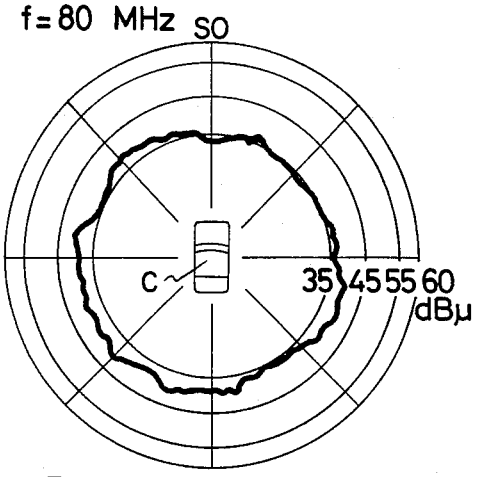
Figure 17B:
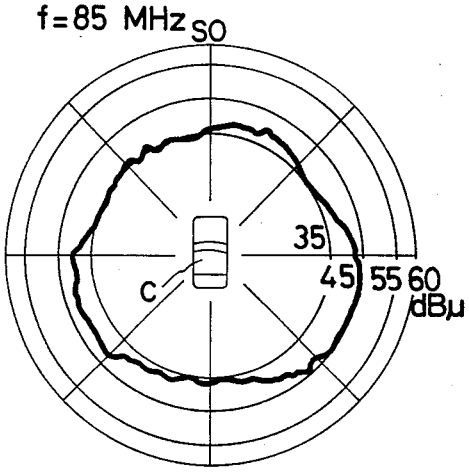
Figure 17C:
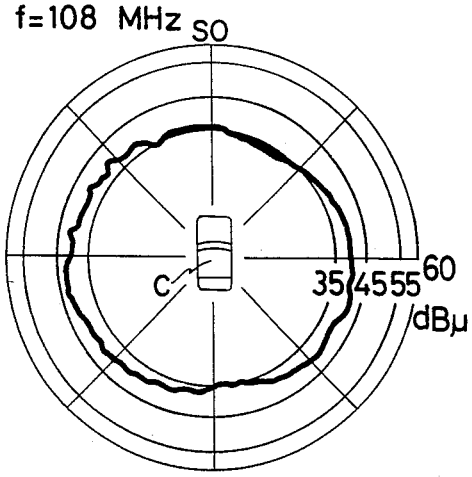
Figure 17D:
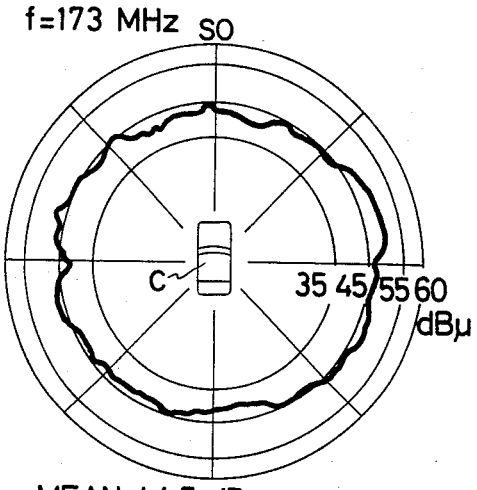
Figure 17E:
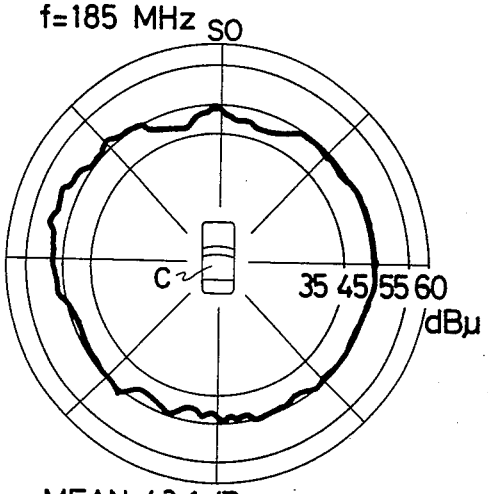
Figure 17F:
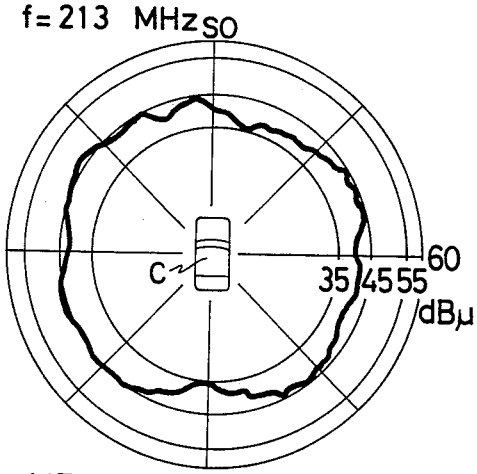
Figure 17G:
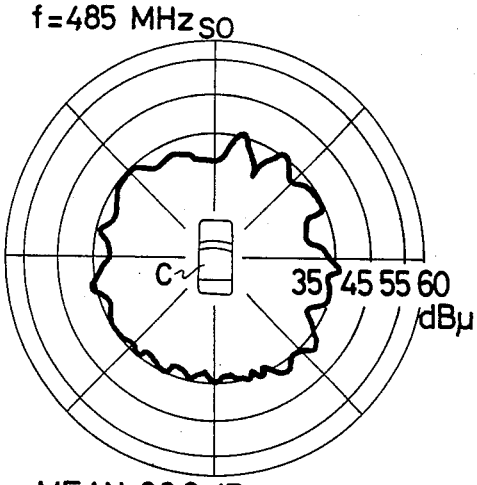
Figure 17H:
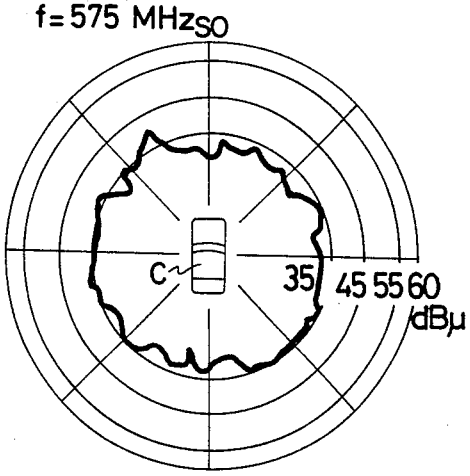
Figure 17I:
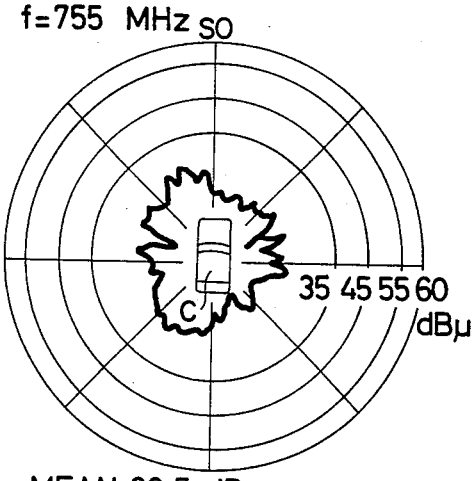

A window antenna of the pattern shown in FIG. 14 was arranged on a fixed rear quarter window on the driver's side of a vehicle, and directivities of this antenna in various frequency ranges were examined, obtaining the results shown in FIGS. 17A to 17I.

In each directivity diagram, a vehicle C, on which the window antenna was mounted, was rotated through 360° with respect to a reference position S0, and a TV broadcast signal (a horizontally polarized wave) was transmitted thereto from the direction of the reference position S0 in a uniform electric field of 60 dBμ, so as to plot reception sensitivity levels (in units of: dBμ) corresponding to respective positions of the vehicle C. Each directivity diagram represents a mean reception sensitivity level (MEAN), a minimum reception sensitivity level (MIN), a maximum reception sensitivity level (MAX), and a directivity (DIR.=(MEAN)−(MIN)).

As can be easily understood from the directivity diagrams, in the TV broadcast signal range of 90 to 755 MHz, a virtually satisfactory reception sensitivity can be obtained, and the directivities are relatively small (5.0 dBμ to 12.9 dBμ). Therefore, the window antenna of this embodiment serves as a non-directivity antenna having a relatively stable reception sensitivity. Note that if an amplifier is added, the reception sensitivity can be increased to a given level.

The window antenna of the present invention can be provided in one or both rear quarter windows of a vehicle. When the window antenna of the present invention is provided in both the rear quarter windows, they can be individually used as antennas for the diversity reception system. Alternatively, when the window antenna of the present invention is provided in one rear quarter window and an antenna having another pattern is provided in the other rear quarter window, they can also constitute the diversity reception system. Moreover, when the window antenna of the present invention is provided in one rear quarter window, it can be combined with at least one other antenna provided on another portion of the vehicle, such as a rear-rod antenna, a front-rod antenna, a rear-whip antenna, and a front-whip antenna, so as to constitute the diversity reception system.

A window glass with an antenna of the present invention can be fitted in a rear quarter window frame, or can be mounted thereon to be open or closed horizontally or vertically by means of a hinge, or can be slidably mounted thereon.

According to the present invention, since the antenna element 3 extends clockwise and the other antenna element 4 extends counterclockwise, respectively from the feed points 3*a* and 4*a* arranged near a single corner portion of the window glass 1, the characteristics of both antenna elements significantly differ. Therefore, when the antenna elements of the present invention are combined in the diversity reception system, high-sensitivity and broad-band reception output can be obtained.

Since the auxiliary element extends between the elements 3 and 4 to complement the impedances thereof, a reception performance can be further improved, as well as obtaining the same effect as in the first embodiment.

What is claimed is:

1. A window antenna mounted on a glass of a rear quarter window of a vehicle, comprising a pair of antenna elements and feed points of said antenna elements, these feed points being arranged at one corner portion of the window, and one antenna element extending clockwise about the center of the window glass and the other antenna extending counterclockwise thereabout, from their corresponding feed points wherein said pair of antenna elements are incorporated in a diversity reception system.

2. A window antenna according to claim 1, wherein said antenna elements are arranged on both rear quarter windows of the vehicle.

3. A window antenna according to claim 1, wherein at least one of said antenna elements have a main element comprising a pair of horizontally extending parallel wires both ends of which are short-circuited and a feeder element connecting said main element to said feed point.

4. A window antenna according to claim 3, wherein said main element extends along one of upper and lower sides of said window and said feeder element extends along one of vertical sides of said window.

5. A window antenna according to claim 1, wherein one of said antenna elements extends along two adjacent sides of said window.

6. A window antenna according to claim 1, wherein one of said antenna elements extends along three sides of said window.

7. A window antenna according to claim 1, wherein one of said antenna elements extends along four sides of said window so as to encircle a rectangular or trapezoidal area corresponding to the window.

8. A window antenna according to claim 1, wherein distal end portions of said antenna elements extend close to one another so as to cause induction with each other.

9. A window antenna according to claim 1, wherein one of said antenna elements comprises a horizontally extending element and another antenna element comprises a vertically extending element.

10. A window antenna mounted on a glass of a rear quarter window of a vehicle, comprising a pair of antenna elements, feed points of said antenna elements arranged at one corner portion of the window, one antenna element extending clockwise about the center of the window glass and the other antenna element extending counterclockwise thereabout, from their corresponding feed points, and an auxiliary element branched from one antenna element to extend along the other antenna element, for correcting the impedance thereof, wherein said pair of antenna elements are incorporated in a diversity reception system.

11. A window antenna according to claim 10, wherein said pair of antenna elements are arranged on both rear quarter windows of the vehicle.

12. A window antenna according to claim 10, wherein said auxiliary element is branched from said feed point.

13. A window antenna according to claim 10, wherein at least one of said antenna elements have a main element comprising a pair of horizontally extending parallel wires both ends of which are short-circuited and a feeder element connecting said main element to said feed point, said main element extending along one of upper and lower sides of said window, said feeder element extending along one of vertical sides of said window, and said auxiliary element extending along said feeder element.

14. A window antenna according to claim 10, wherein said auxiliary element extends horizontally.

15. A window antenna according to claim 10, wherein said auxiliary element extends vertically.

* * * * *